US008152001B1

(12) United States Patent
Vinklarek et al.

(10) Patent No.: US 8,152,001 B1
(45) Date of Patent: Apr. 10, 2012

(54) ELASTIC ARTICLE RETAINER FOR DISHWASHERS

(75) Inventors: Victor A. Vinklarek, Austin, TX (US); Joseph A. Decker, Jr., Katy, TX (US); Laurie K. Vinklarek, Austin, TX (US)

(73) Assignees: Victor A. Vinklarek, Austin, TX (US); Laurie K. Vinklarek, Austin, TX (US); Joseph A. Decker, III, Katy, TX (US)

( * ) Notice: Subject to any disclaimer, the term of this patent is extended or adjusted under 35 U.S.C. 154(b) by 314 days.

(21) Appl. No.: 12/380,348

(22) Filed: Feb. 25, 2009

Related U.S. Application Data

(60) Provisional application No. 61/109,501, filed on Oct. 29, 2008.

(51) Int. Cl.
*A47G 19/08* (2006.01)

(52) U.S. Cl. ..... 211/41.9; 211/180

(58) Field of Classification Search ..... 211/41.8, 211/41.9, 180, 183; D32/3, 25; 294/77; 293/40; 140/3 R, 5
See application file for complete search history.

(56) References Cited

U.S. PATENT DOCUMENTS

| | | | | | |
|---|---|---|---|---|---|
| 2,328,474 | A | * | 8/1943 | Lewis | 24/300 |
| 4,008,548 | A | * | 2/1977 | Leclerc | 52/180 |
| 4,047,550 | A | * | 9/1977 | Scholz | 220/315 |
| D274,948 | S | * | 7/1984 | Swanson et al. | D25/156 |
| 4,596,731 | A | * | 6/1986 | Cudmore et al. | 428/134 |
| 4,832,206 | A | | 5/1989 | Cunningham | |
| 4,834,125 | A | * | 5/1989 | Insalaco | 134/201 |
| 4,974,806 | A | | 12/1990 | Matern | |
| 5,114,019 | A | * | 5/1992 | Sandbank | 211/41.9 |
| 5,121,843 | A | * | 6/1992 | Elder | 211/41.9 |
| 5,201,826 | A | | 4/1993 | Zimmermann | |
| D338,750 | S | * | 8/1993 | Chandler | D32/3 |
| 5,294,008 | A | | 3/1994 | Dunaway | |
| D362,520 | S | * | 9/1995 | Lunsford | D32/3 |
| D368,340 | S | * | 3/1996 | Mussmacher et al. | D32/3 |
| 5,518,126 | A | * | 5/1996 | Davis | 211/41.8 |
| D398,090 | S | * | 9/1998 | Busby, Sr. | D32/3 |
| D398,091 | S | * | 9/1998 | Badgett et al. | D32/3 |
| 5,803,391 | A | * | 9/1998 | Saperstein et al. | 242/395 |
| 5,857,473 | A | * | 1/1999 | Vanover et al. | 134/135 |
| 5,988,406 | A | * | 11/1999 | Leipziger | 211/41.9 |
| 6,065,916 | A | * | 5/2000 | Swensen | 410/97 |
| D471,679 | S | * | 3/2003 | Henzey | D32/3 |
| 6,675,977 | B2 | | 1/2004 | Parks | |
| 2003/0019826 | A1 | * | 1/2003 | Edwards | 211/123 |
| 2007/0056919 | A1 | * | 3/2007 | Moore | 211/41.9 |

* cited by examiner

*Primary Examiner* — Jennifer E. Novosad

(57) ABSTRACT

A generally rectangular flexible elastic article retainer for retaining articles in a dishwasher rack has laterally opposed longitudinal sides, each having a plurality apertures configured to securely engage selected upstanding or horizontal wire-like members of the dishwasher rack frame and a center portion formed of a plurality of transverse thin elastic bands disposed in parallel spaced relation for engaging and securing articles loaded into the rack. When the elastic bands are stretched across the articles, some of the bands may be positioned to extend across the upward facing bottom surface of shorter inverted articles, such as cups, bowls or short containers, to prevent vertical movement and overturning; while at the same time other pairs of the bands of the same article retainer may be positioned on the lateral sides of adjacent taller inverted objects, such as drinking glasses, to securely grip the sides of the taller articles to prevent vertical movement and overturning.

5 Claims, 3 Drawing Sheets

ELASTIC ARTICLE RETAINER FOR DISHWASHERS

CROSS REFERENCE TO RELATED APPLICATION

This application claims priority of U.S. Provisional Patent Application Ser. No. 61/109,501 filed Oct. 29, 2008.

BACKGROUND OF THE INVENTION

1. Field of the Invention

This invention relates generally to devices for restraining movement of articles disposed in a rack of a dishwasher and, more particularly, to a generally rectangular flexible elastic article retainer for retaining articles in a dishwasher rack that has laterally opposed longitudinal sides configured to securely engage the upstanding or horizontal wire-like members of the dishwasher rack frame and a center portion formed of a plurality of transverse thin resilient bands disposed in parallel spaced relation for engaging and securing separate articles loaded into the rack.

2. Background Art

As well known in the art, most dishwashers include a rack for holding dinnerware and cookware articles, such as dishes, bowls, cups, glasses, plastic containers, lids, pots, pans, etc., to be washed. The typical dishwasher rack of the type used in most home and commercial dishwashers is in the form of a substantially rectangular open frame or basket having a bottom and four sides, with relatively widely parallel spaced apart plastic covered wire support members that extend between the sides in a crisscross pattern to form the bottom support members of the rack and are turned upwardly on the ends to form vertical side support members that are adjoined at their top ends to a generally rectangular plastic coated top frame member. The bottom support members are connected, at intermediate points within the rack, to plastic covered wire upright support members or "prongs" that extend upwardly from the bottom support members that are typically used to hold articles in a row or column of the rack. The prongs provide support for and separate articles loaded into the rack. Articles, such as cups, glasses, plates and bowls, are placed in the rack between prongs. Except when they are large enough to be held in the rack by friction, the objects are not restrained in the rack other than the proximity of other objects, the prongs, and the sides of the rack.

Jets are usually positioned in the dishwasher housing at the top and/or bottom of the housing, which direct the water under high pressure onto the articles. Water from the high-pressure jets causes movement of the unrestrained objects. When the articles are glass or ceramic, times the movement will often cause them to collide and chip or break. When the articles, such as bowls, cups, glasses, and plastic containers, are plastic, they are usually placed in the rack with their open end or concave surface facing down or to one side. However, the force of the jets is generally sufficient to overturn the articles such that their open end or concave surface is facing upward and they become filled with dirty water and debris.

Others have attempted to overcome these damage and capsizing problems. For example, there are several patents directed toward mesh net devices and devices having elongate parallel elastic bands with fasteners at each end, some of which apply pressure to the lateral sides of the article.

One of the problems associated with net type retainer devices is that if the openings in the mesh are small, the net may obstruct any cleansing action. Also when the net is suspended over taller articles, the shorter articles adjacent to or surrounding the taller articles are no longer restrained from movement and are thus susceptible to overturning.

Some of the problems associated with most hold-down devices utilizing parallel elongate elastic bands with fasteners at each end is that they typically are used to hold articles in a row or column of the rack, thus several units are required to retain a number of articles, and the task of positioning one parallel cord unit for each row or column of each rack is time consuming. Another problem with these types of devices that apply pressure to the lateral sides of the articles is that the restraining pressure will be uniformly applied to each article only if all of the articles are of the same lateral dimension. Thus, two narrow objects surrounded by two wide objects would not be restrained at all.

Cunningham, U.S. Pat. No. 4,832,206 discloses a rectangular elastic mesh device for holding articles in place in a dishwasher, which is dimensioned to overlie at least a portion of the rack and extends substantially across the space between the ends. The mesh has small openings and has rigid plastic connector bars attached at opposite ends that are placed between upstanding wire-like frame members on the outer ends of the dishwasher rack. The device is designed to cover one row or column of the rack. In addition to the time consuming task of positioning one mesh device for each row or column of each rack, the mesh device would not prevent the damage and overturning problems described above.

Zimmerman, U.S. Pat. No. 5,201,826 discloses a rectangular elastic mesh device for holding articles in place in a dishwasher, which is dimensioned to overlie the top of the rack and has a stretchable surrounding peripheral edge that extends over the sides and ends of the rack, and includes a plurality of T-shaped pin members of various lengths each having a vertical shank portion with a notched bottom end. The shanks of the T-shaped pins are extended through selected openings in the mesh member such that the notched bottom ends are engaged on the wire-like bottom frame members of the rack to prevent smaller items from turning upright or becoming dislodged. Thus, the user has a time consuming task of positioning a plurality of the T-shaped pins at strategic locations to effectively prevent the overturning problems described above.

Dunaway, U.S. Pat. No. 5,294,008 discloses a rectangular elastic net having an outer periphery conforming substantially to the open top of the rack wherein the outer edges of the net slightly overlap the periphery of rack and is secured to the rack by a plurality clips attached at spaced apart increments around the periphery of the net. When the net is stretched across the top of rack and connected to the sides of the rack, the net is sufficiently stiff to remain substantially flat across the top of rack above objects whose height does not exceed that of the rack to prevent vertical movement of these objects. The openings of the net are of such size that the taller objects whose lateral dimensions exceed somewhat the lateral dimensions of the openings may extend therethrough without lifting the net from above the shorter objects. Additional clips or hooks may be used to secure the net to the wire-like bottom frame members such that it extends over taller articles such as plates. Thus, the user has a time consuming task of positioning a plurality of the clips at strategic locations adjacent to taller articles such as plates to effectively prevent the overturning problems described above Matern, U.S. Pat. No. 4,974,806 discloses a flexible dishwashing accessory having elongated flexible cords that put pressure on utensils to be retained in a dishwasher rack. The device includes a pair of elongate, flexible cords each of which is attached at opposed ends to a transverse attachment member to extend between attachment members in parallel spaced relation. The attachment members have a hook or a notch for engaging the wire-like frame members of the rack. The flexible cords are spread apart slightly to allow a glass or other article to be placed therebetween in a row or column of the rack, then when the cords are released, they securely grip against the sides of the glass or other article holding it in place in the rack. The device is designed to grip the lateral sides of articles in one row or column of the rack; thus, several units are requited to retain a number of articles. Another problem is that the restraining pressure will be uniformly applied to each object only if all of the objects in the row or column are of the same lateral dimension. Thus, narrow objects adjacent to wider objects would not be restrained at all.

Parks, U.S. Pat. No. 6,675,977 discloses a dual band dishwasher clip for retaining and preventing undesired movement of articles such as lightweight, typically plastic articles, in a dishwasher rack. The dual band dishwasher clip includes a pair of clip fasteners having a hooked end for engaging the wire-like members of the dishwasher rack frame, a transverse crosspiece at the opposed end having a curved band stay at each end, and an elastic band loop that is fed through each band stay to define a pair of parallel spaced band segments extending between the clip fasteners. The parallel spaced band segments extend over articles in the dishwasher rack and the clip fasteners are hooked onto the wire-like bottom frame members adjacent to the articles. The device is designed to cover articles in one row or column of the rack; thus, several units are required to retain a number of articles. Another problem with this device is that it applies pressure to the top surface of the articles and shorter articles adjacent to taller articles would not be restrained at all.

SUMMARY OF THE INVENTION

The present invention overcomes the aforementioned problems and is distinguished over the prior art in general, and these patents in particular, by a generally rectangular flexible elastic article retainer for retaining articles in a dishwasher rack. The retainer has laterally opposed longitudinal sides with a plurality of holes or holes and slits configured to securely engage selected upstanding or horizontal wire-like members of the dishwasher rack frame and a center portion formed of a plurality of transverse thin elastic bands disposed in parallel spaced relation for engaging and securing articles loaded into the rack. When the elastic bands are stretched across the articles, some of the bands may be positioned to extend across the upward facing bottom surface of shorter inverted articles, such as cups, bowls or short containers, to prevent vertical movement and overturning; while at the same time other pairs of the bands of the same article retainer may be positioned on the lateral sides of adjacent taller inverted objects, such as drinking glasses, to securely grip the sides of the taller articles to prevent vertical movement and overturning.

One of the features and advantages of the present invention is that it is of unitary one-piece construction and does not require additional connector members, such as bars, clips, pins or the like, for securing it to a dishwasher rack.

Another feature and advantage of the present invention is that it can be easily and quickly attached to and detached from selected upstanding wire-like members of the dishwasher rack frame.

Another feature and advantage of the present invention is that it utilizes a plurality of transverse thin elastic bands disposed in parallel spaced relation for engaging and securing articles loaded into the rack whereby some of the bands may be positioned to extend across the upward facing bottom surface of shorter inverted articles to prevent vertical movement and overturning; and other pairs of the bands of the same article retainer may be positioned on the lateral sides of adjacent taller inverted objects, to securely grip the sides of the taller articles to prevent vertical movement and overturning.

Another feature and advantage of the present invention is that it accommodates attachment to a wide variety of dishwasher racks having different spacing between the vertical side support members and upright intermediate support members or prongs of the rack.

A further feature and advantage of the present invention is that it has an attachment configuration that allows the bands to be tightly stretched under tension and significantly reduces the likelihood of the article retainer being accidentally detached due to the tension forces and the force of high-pressure water jets during the washing operation.

A still further feature and advantage of the present invention is that it is simple in construction, inexpensive to manufacture, rugged, long lasting and durable in use.

DESCRIPTION OF THE PREFERRED EMBODIMENTS

Figure 1:
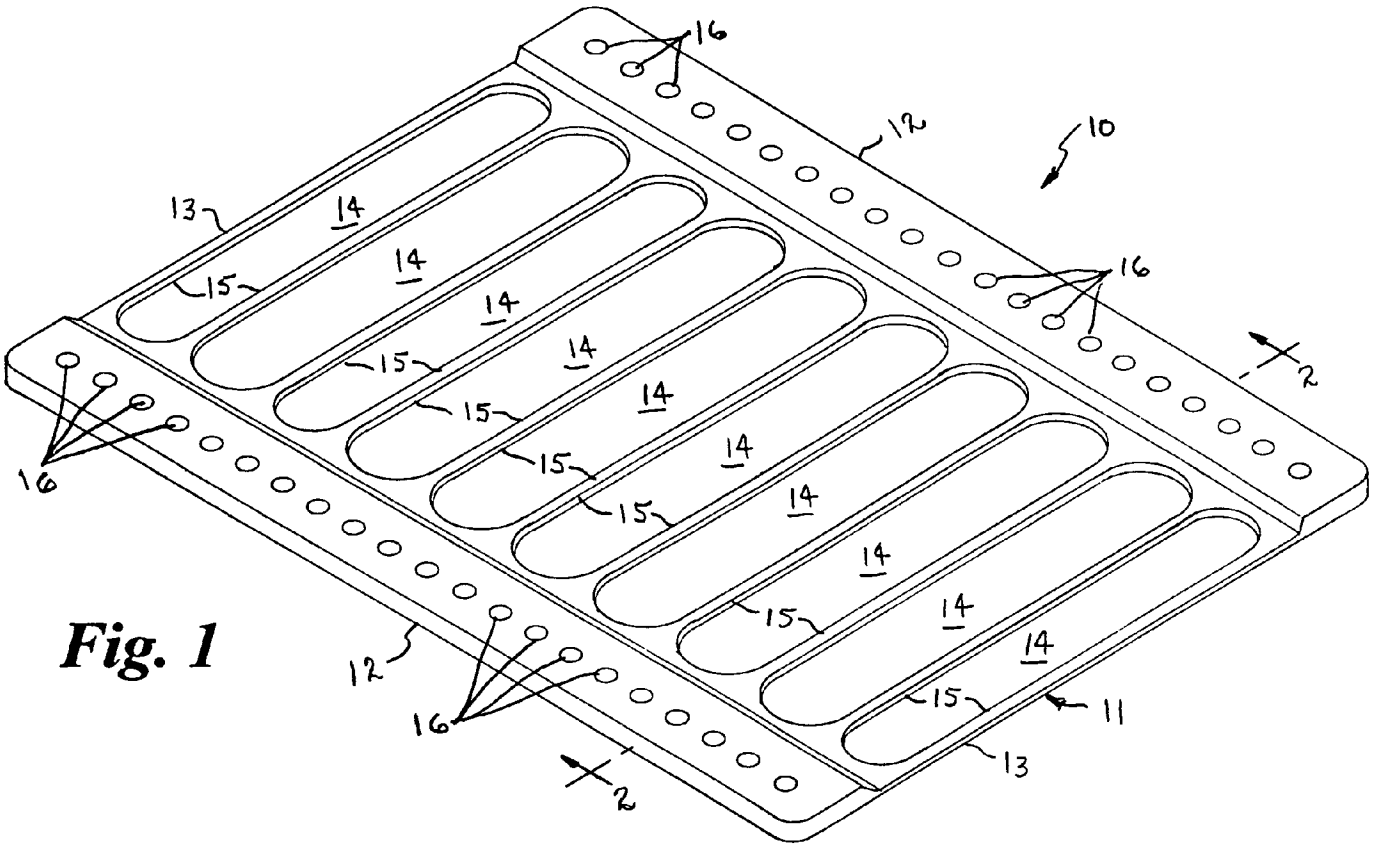
FIG. 1 is a top plan view of the elastic article retainer device in accordance with the present invention.

As discussed briefly above, a typical dishwasher rack of the type used in most home and commercial dishwashers is in the form of a substantially rectangular open frame or basket having a bottom and four sides with relatively widely parallel spaced apart plastic covered wire support members that extend across the bottom between the sides in a crisscross pattern to form the bottom support members of the rack and are turned upwardly on the ends to form vertical side support members that are adjoined at their top ends to a generally rectangular plastic coated top frame member. The bottom support members are connected, at intermediate points within the rack, to plastic covered wire upright intermediate support members or "prongs" that extend upwardly from the bottom support members that are typically used to hold the articles in a row or column of the rack Referring now to FIGS. 1 and 2, there is shown a preferred elastic article retainer 10 for retaining articles in a dishwasher rack in accordance with the present invention. The article retainer 10 is of unitary one-piece construction formed of a suitable heat and water resistant elastic resilient elastomer material such as, but not limited to, silicone rubber, or neoprene AX-1060 or 1050, natural rubber, butyl, ethylene propylene diene (EODM), nitrile (Buna-N), and styrene butadiene.

The article retainer 10 has a generally rectangular configuration with a thin flat central portion 11, laterally opposed longitudinal sides 12, and opposed ends 13. The thin flat central portion 11 has a plurality of elongate openings 14 extending transversely between the longitudinal sides in closely spaced apart parallel relation defining a plurality of integrally formed thin elastic bands 15 extending transversely between the longitudinal sides 12 in parallel spaced apart relation between the opposed ends.

In a preferred embodiment, the thin flat central portion 11 has a thickness of about 1/16", each thin elastic band 15 has a thickness of about 1/16" and a width of about 1/8", the transverse elongate openings 14 have a width of about 3/4" with curved ends, and each longitudinal side 12 has a width of about 1" and a thickness of about 3/16". The dimensions are given for purposes of example only and are not limited to the recited dimensions.

A plurality of holes 16 are formed through each of the longitudinal sides 12 in longitudinally spaced apart relation. In a preferred embodiment, the holes 16 are about 3/16" in diameter and are spaced about 1/2" apart along the length of the longitudinal sides 12 and about 3/8" inwardly from the outer edge of the longitudinal sides. The dimensions are given for purposes of example only and are not limited to the recited dimensions.

It has been found that the present article retainer 10, when formed of silicone rubber, provides sufficient elasticity to allow the elastic bands 15 to be stretched entirely across the width of the rack of a standard size home dishwasher. Thus, one single retainer is capable of holding articles in several, or all, of the rows or columns of the rack.

Figure 3:
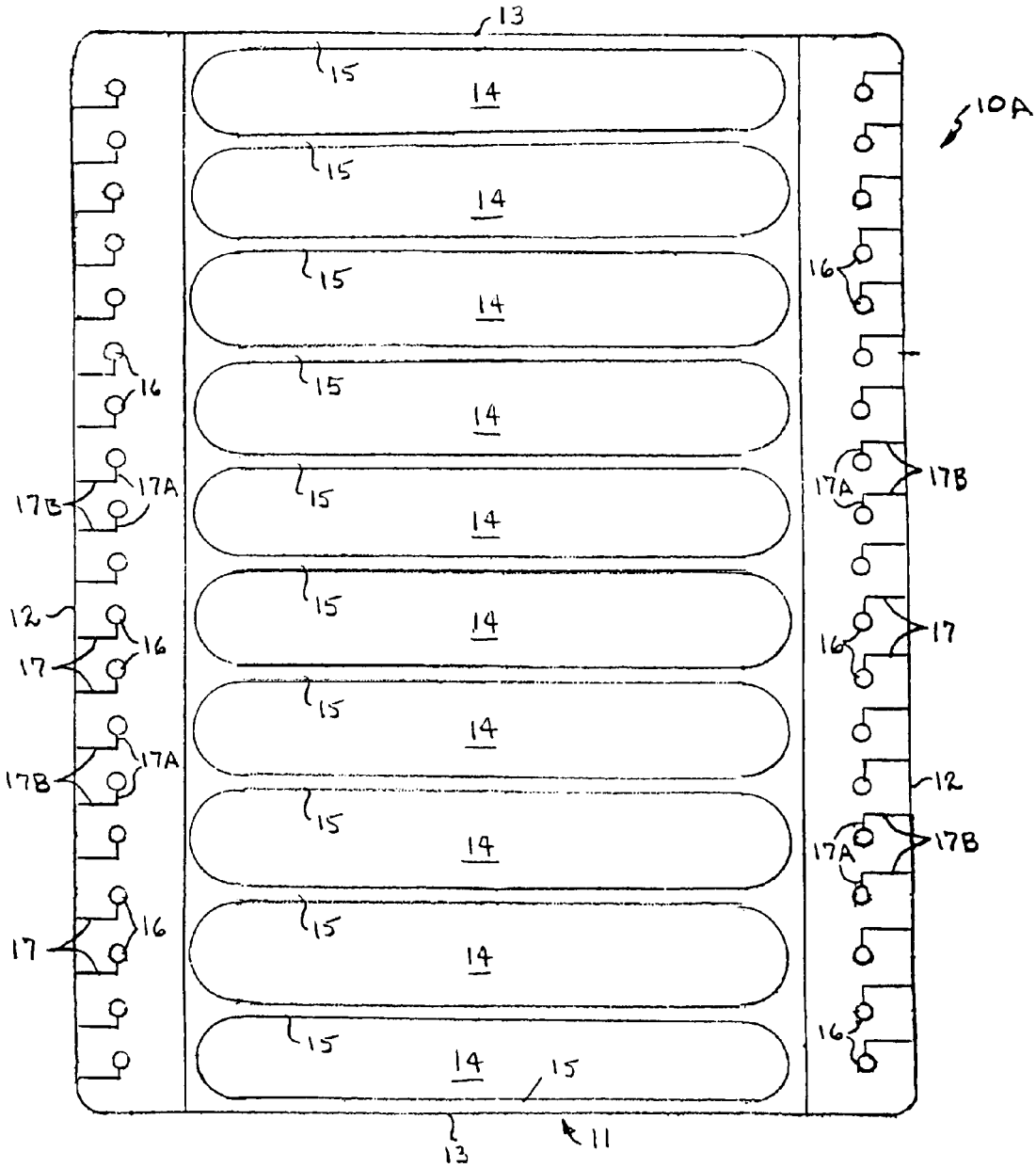
FIG. 3 is a top plan view of a modification of the elastic article retainer device having a plurality of generally L-shaped slits formed in the longitudinal sides, each extending outwardly from a respective hole to the exterior of the respective longitudinal side.

In a modification of the article retainer 10A, as shown in FIG. 3, a plurality of generally L-shaped slits 17 may be formed in the longitudinal sides 12, each having a shorter leg portion 17A extending outwardly from a respective hole 16 and an adjoining longer leg portion 17B, perpendicular to the shorter leg portion, extending to the exterior of each longitudinal side, respectively. In this modification, the plurality of generally L-shaped slits 17 in one longitudinal side 12 are disposed in offset relation with respect to the slits in the other longitudinal side. In other words, the shorter leg portions 17A of one longitudinal side extend outwardly from a respective hole 16 in a direction toward one end of the retainer and the shorter leg portions of the other longitudinal side extend outwardly from a respective hole in a direction toward the opposite end. Thus, the adjoining longer leg portions 17B of the slits 17 in the respective longitudinal sides 12 are disposed in longitudinally offset relation, respectively.

Operation

In use, the articles to be washed are placed in the rack and supported between the prongs of the rack in a conventional manner. Articles, such as cups, glasses, bowls, and containers, are placed in the rack between the prongs with their open end or concave surface facing down.

Figure 2:
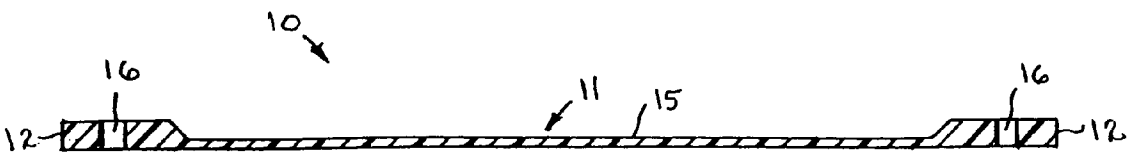
FIG. 2 is a transverse cross section of the elastic article retainer device, taken along line 2-2 of FIG. 1.
Figure 4:
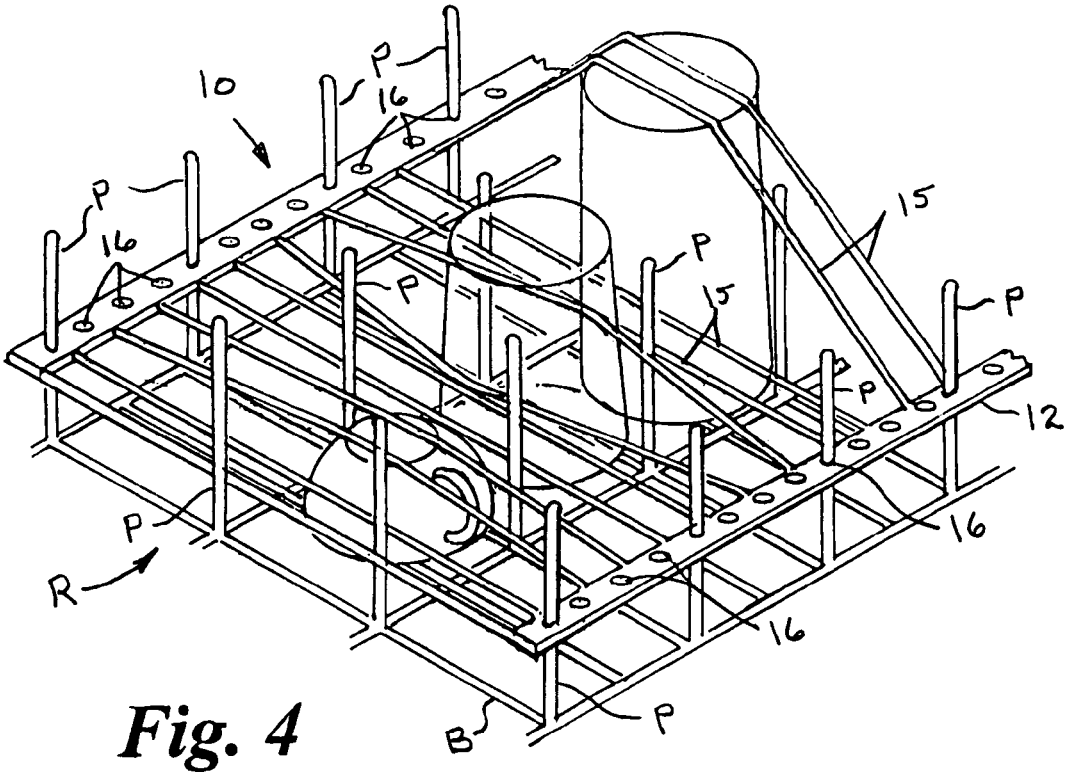
FIG. 4 is a perspective view showing the article retainer of FIG. 1 with the opposed sides installed on upright intermediate prongs of a dishwasher rack and in the stretched condition with the elastic bands holding articles in the rows or columns of the rack.

FIG. 4 shows the article retainer of FIG. 1 with the opposed sides installed on upright intermediate prongs P of a dishwasher rack R and in the stretched condition with the elastic bands holding articles in the rows or columns of the rack.

A first longitudinal side 12 of the article retainer 10 is secured onto at least two intermediate upright support members or prongs P of the rack R that are located inwardly from the sides of the rack by pressing selected holes 16 along the first side onto the corresponding prongs. The second longitudinal side 12 of the retainer 10 is then pulled a distance away from the secured side such that the thin elastic bands 15 are stretched across and over the articles to be held and it is then secured onto at least two upright intermediate support members or prongs P by pressing the appropriate holes 16 onto the corresponding prongs such that the retainer is frictionally engaged along opposed sides on the distantly spaced apart prongs.

Because the article retainer 10 has a plurality of parallel closely spaced thin elastic bands 15, when stretched across the articles, some of the bands may be positioned to extend across the upward facing bottom surface of shorter inverted articles, such as cups, bowls or short containers, to prevent vertical movement and overturning, while at the same time other pairs of the bands of the same article retainer may be positioned on the lateral sides of adjacent taller inverted objects, such as drinking glasses, whose lateral dimension exceed the lateral dimensions of the openings between the bands, such that the bands securely grip the sides of the taller articles to prevent vertical movement and overturning. The bands 15 may also be manually positioned to place them in a desired to extend across and/or to straddle various articles. Thus, a single article retainer can be used to prevent vertical movement and overturning of both shorter articles and taller articles.

The plurality of closely spaced holes 16 in the longitudinal sides 12 of the article retainer 10 allows it to accommodate attachment to a wide variety of dishwasher racks having different spacing between the prongs. The bands 15 are tightly stretched under tension and significantly reduce the likelihood of the article retainer 10 from being accidentally detached due to the tension forces and the force of the high-pressure water jets during the washing operation.

The thicker longitudinal sides 12 of the article retainer 10 add increased strength and stiffness at the point of attachment to the prongs to increase the ease of manually attaching the article retainer and thereafter reduce unnecessary movement and accidental detachment.

Figure 5:
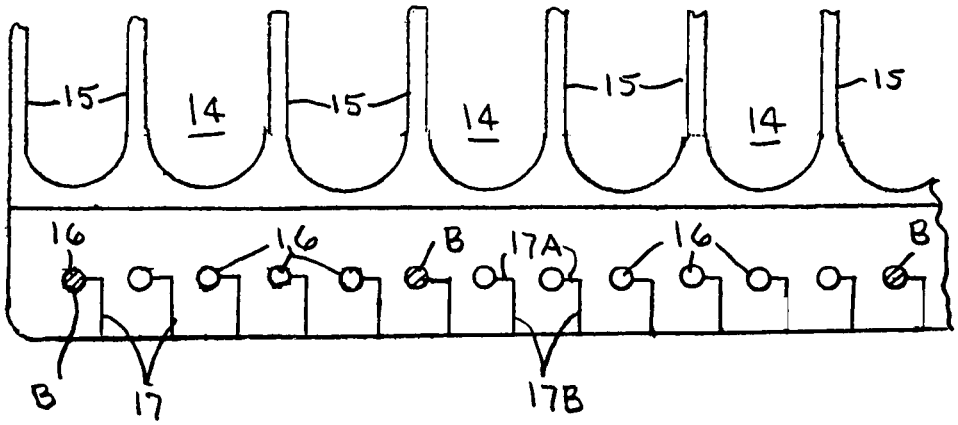
FIG. 5 is a side elevation view showing a portion of one side of the article retainer of FIG. 3 engaged on horizontal support members of a dishwasher rack.

FIG. 5 shows a portion of one side of the modified article retainer 10A of FIG. 3 engaged on horizontal bottom support members B of a dishwasher rack. The installation of the modified article retainer 10A is essentially the same as described above, and the opposed longitudinal sides may be installed either on the intermediate upright prongs P of the rack that are located inwardly from the sides of the rack, or on the vertical side support members and bottom support members of the rack. With the modified retainer 10A, the elongate leg portion 17B of the appropriate slits 17 are pressed onto the corresponding rack support members and then the longitudinal side is moved toward the front or back of the rack such that the vertical side support member or bottom support member B is passed through the adjoining shorter leg portion 17A of the slit and snaps into the hole 16. It should be understood that the opposed longitudinal sides of the retainer 10 can be secured, in the same manner, onto laterally spaced upright prong members that are located inwardly from the sides of the rack. The combination of the holes 16 and slits 17 in the longitudinal sides 12 allows the retainer to accommodate attachment to a wide variety of dishwasher racks having different spacing between the vertical side support members and upright intermediate support members or prongs or the bottom support members.

As discussed above, the present article retainer 10, when formed of silicone rubber, provides sufficient elasticity to allow the elastic bands 15 to be stretched entirely across the width of the rack of a standard size home dishwasher. Thus, one single retainer is capable of holding articles in several, or all, of the rows or columns of the rack. The elasticity also allows a user to stretch the bands while the retainer is installed, to place articles into, or remove them from, the rack. Thus, the retainer may be left in place and it is not necessary to remove and install the retainer each time the articles are washed.

It should be understood that the article retainers in accordance with the present invention may be provided in various sizes, widths, and lengths. For example, but not limited thereto, the article retainers 10, 10A may have a width sufficient to allow them to be stretched laterally over one column, or more than one column, of stacked articles. The article retainers 10, 10A may have a length sufficient to allow them to extend the entire length of a column of the rack. The article retainers 10, 10A may also have a length shorter than a column of the rack and be secured end-to-end or overlapped end-to end to accommodate racks having different column lengths.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A one-piece elastic retainer device for retaining articles of varying sizes and shapes to be washed in a dishwasher rack, the rack having a frame formed of horizontal and upright support members for supporting the articles in the rack, the retainer device comprising:

a generally rectangular flexible elastic retainer device having laterally opposed longitudinal side portions with opposed ends, said longitudinal side portions having a first thickness;

an integrally formed central portion having a plurality of elongate openings extending transversely between said opposed longitudinal side portions in closely spaced apart parallel relation defining a plurality of separate elongate narrow elastic bands extending transversely between said longitudinal side portions in parallel spaced apart relation between said opposed ends, said elastic bands having a second thickness less than said first thickness of said longitudinal side portions; and a plurality of holes in each of said longitudinal side portions disposed in longitudinally spaced apart relation along said longitudinal side portions for receiving and engaging selected upright or horizontal support members of the dishwasher rack frame;

wherein selected said holes of a first one of said longitudinal side portions are adapted to receive and engage at least two horizontal or upright support members of the rack frame, selected said holes of the second one of said longitudinal side portions are adapted to receive and engage at least two horizontal or upright support members of the rack frame spaced a distance from said first one of said longitudinal side portions, and said elastic bands are adapted to be stretched across articles in the dishwasher rack frame to prevent substantial vertical movement and overturning thereof.

2. The elastic retainer device according to claim 1, wherein said plurality of elastic bands are of sufficient number, sufficient elasticity, and spaced a sufficient distance apart to provide selective positioning of one or more of said bands in a stretched condition across upward facing ends articles of varying heights supported in the dishwasher rack frame to prevent vertical movement and overturning thereof, and allow passage of upward facing ends of inverted articles between pairs of said bands in a stretched condition wherein said pairs of bands straddle and resiliently grip lateral sides of the inverted articles to prevent vertical movement and overturning thereof.

3. The elastic retainer device according to claim 1, wherein further comprising:

a plurality of generally L-shaped slits formed in said longitudinal side portions, each having a shorter leg portion extending outwardly from a respective one of said holes and an adjoining longer leg portion perpendicular to said shorter leg portion extending to the exterior of each of said longitudinal side portions, respectively.

4. The elastic retainer device according to claim 1, wherein said retainer device is formed of a heat and water resistant elastic resilient elastomer material selected from the group consisting of silicone rubber, neoprene, natural rubber, butyl, ethylene propylene diene (EODM), nitrile (Buna-N), and styrene butadiene.

5. A method for retaining articles in a dishwasher rack having a frame formed of horizontal and upright support members, comprising the steps of:

providing a one-piece generally rectangular flexible elastic retainer device having first and second laterally opposed longitudinal portions and opposed ends, said longitudinal side portions having a first thickness, an integrally formed central portion having a plurality of elongate openings extending transversely between said opposed longitudinal side portions in closely spaced apart parallel relation defining a plurality of separate elongate narrow elastic bands extending transversely between said longitudinal portions in parallel spaced apart relation between said opposed ends, said elastic bands having a second thickness less than said first thickness of said longitudinal side portions, and a plurality of holes in each of said longitudinal side portions disposed in longitudinally spaced apart relation along said longitudinal side portions;

placing articles of varying heights having a bottom end and an opposed open end or concave surface in the rack so as to be supported on the horizontal support members of the frame between the upright support members in an inverted position with their bottom end facing upward and their open end or concave surface facing down;

pressing selected holes of said first longitudinal side portion of said retainer device onto selected upright or horizontal support members of the dishwasher rack frame so as to engage said first longitudinal side portion thereon;

pulling said second longitudinal side portion of said retainer device a distance away from said first longitudinal side portion to stretch said elastic bands across and over the articles and pressing selected holes of said second longitudinal side of said retainer device onto selected distantly spaced upright or horizontal support members of the dishwasher rack frame so as to engage said second longitudinal side portion thereon; and positioning selected elastic bands in the stretched condition across upward facing bottom ends of shorter inverted articles, and positioning selected pairs of said elastic bands in the stretched condition on respective lateral sides of taller inverted articles beneath their upward facing bottom ends to straddle the lateral sides of the taller inverted articles and securely grip the lateral sides, to prevent vertical movement and overturning of the shorter and taller articles during a washing cycle.

* * * * *